US005402660A

United States Patent [19]

Osada

[11] Patent Number: 5,402,660

[45] Date of Patent: Apr. 4, 1995

[54] AXIAL TUMBLER CYLINDER LOCK AND KEY

[75] Inventor: Shunichi Osada, Yokohama, Japan

[73] Assignee: Alpha Corporation, Kawasaki, Japan

[21] Appl. No.: 128,776

[22] Filed: Sep. 30, 1993

[30] Foreign Application Priority Data

Mar. 24, 1993 [JP] Japan ..... 5-065610

[51] Int. Cl.[6] ..... E05B 27/08

[52] U.S. Cl. ..... 70/491; 70/395; 70/397; 70/404; 70/454

[58] Field of Search ..... 70/491, 453, 454, 403, 70/404, 395, 397, 398, 414

[56] References Cited

U.S. PATENT DOCUMENTS

| | | | |
|---|---|---|---|
| 54,678 | 5/1866 | Bowman | 70/404 |
| 3,339,384 | 9/1967 | Greenwald | 70/454 |
| 3,903,720 | 9/1975 | Scherbing | 70/454 X |
| 3,992,907 | 11/1976 | Pilvet | 70/491 X |
| 4,100,777 | 7/1978 | Fredon | 70/491 |
| 4,191,036 | 3/1980 | Steinbach | 70/491 |
| 4,831,853 | 5/1989 | Liao | 70/491 |
| 5,024,072 | 6/1991 | Lee | 70/491 |

FOREIGN PATENT DOCUMENTS

| | | | |
|---|---|---|---|
| 388911 | 1/1924 | Germany | 70/491 |
| 2037873 | 7/1980 | United Kingdom | 70/491 |
| 0520794 | 3/1977 | U.S.S.R. | 70/491 |

*Primary Examiner*—Lloyd A. Gall
*Attorney, Agent, or Firm*—Foley & Lardner

[57] ABSTRACT

A cylinder lock having a key insertion hole or clearance formed between a casing and a key guide member. A key for the cylinder lock is provided with a thin cylindrical member which is to be inserted into the annular key insertion hole when the key is inserted into the cylinder lock. The cylindrical member is filled at its first end section with a part of a key shank. A slider is slidably disposed inside the cylindrical member and normally located inside the second end section of the cylindrical member. The slider is formed at its tip end with a fitting projection which is to be fitted in a guiding depression formed at the tip end face of the key guide member. The key insertion hole is formed narrow or thin, corresponding to the thin cylindrical member of the key, thereby preventing a picking tool from being inserted through the narrow key insertion hole into the cylinder lock.

6 Claims, 4 Drawing Sheets

AXIAL TUMBLER CYLINDER LOCK AND KEY

BACKGROUND OF THE INVENTION

1. Field of the Invention

This invention relates to improvements in a cylinder lock, and more particularly a cylinder lock associated with a key therefor, arranged to effectively prevent an illegal unlocking of the cylinder lock.

2. Description of the Prior Art

Hitherto a variety of cylinder locks are proposed and put into practical use. The cylinder locks include a so-called axially operated type lock which is generally arranged as follows: A lock cylinder is rotatably disposed inside a casing to form an annular key insertion hole therebetween. When a key having a cylindrical tip end section is inserted into the key insertion hole, tumbler-pins in the cylinder lock are slid axially thereby making the lock cylinder rotatable. Such a cylinder lock is advantageous as it can be set to many key chords. Additionally, in this cylinder lock, the key in its unlocked position can be extracted from the lock cylinder, thereby preventing leaving the cylinder lock unlocked. Accordingly, such cylinder locks have been extensively used for automatic vending machines, lockers, or the likes.

The internal structure of a typical one of the cylinder locks will be briefly explained with reference to FIG. 6. The cylinder lock includes a generally cylindrical casing 1' which is formed with a bore defined by its inner peripheral surface 2'. The casing 1' is provided at its left end with a generally cylindrical front wall 3' which radially inwardly projects over the inner peripheral surface 2' to form an annular step wall surface 4' perpendicular to the axis of the cylinder lock. The step wall surface 4' is located between the inner peripheral surface of the front wall 3' and the inner peripheral surface 2'. A cylindrical sleeve 5' is disposed at the right half section of the bore of the casing 1'. A hole 6' is formed throughout the casing 1' and the sleeve 5' and opened at the outer peripheral surface of the casing 1'. A fixing pin 7' is fitted in the hole 6', thereby fixing the sleeve 5' to the casing 1'. The left end face of the sleeve 5' forms an annular wall surface 8' perpendicular to the inner peripheral surface 2' of the casing 1'.

A plurality of under-pin holes 9' are formed at the annular wall surface 8' and extend axially to a closed bottom. An under-pin 11' is disposed in each under-pin hole 9'. Accordingly, each under-pin 11' is biased in a direction to project leftward over the annular wall surface 8' under the bias of a spring 10'.

A lock cylinder 12' is rotatably disposed in the bore of the casing 1' and formed at its tip end with a key guide section **12*a*'. An annular key insertion hole 13' is formed between the key guide section 12*a*' and the front wall 3' of the cylinder 1'. The lock cylinder 12' is formed at its central portion with a flange section 12*b*', which is in slidable contact with the annular wall surface 8'. The lock cylinder 12' has a shaft section 12*c*' which extends rightward from the flange section 12*b*' and is located inside the sleeve 5'. The shaft section 12*c*' projects rightward over the right end wall of the casing 1' to form an end portion. The end portion of the shaft section 12*c*' is formed at its outer peripheral surface with an external thread. The external thread is engaged with an internal thread of a nut 17'. A cam 14' is fixedly mounted the end portion of the shaft section 12*c*' of the key cylinder 12' and located between the casing 1' and the nut 17'**.

The flange section **12*b*' of the lock cylinder 12' is formed with a plurality of tumbler-pin holes 15' which are locatable to agree respectively to the under-pin holes 9'. A plurality of tumbler-pins 16' are inserted and disposed respectively in the tumbler-pin holes 15'**.

Under a locked condition of the cylinder lock, the tip end section of each under-pin 11' is inserted in or engaged with the tumbler-pin holes 15'. Therefore, the lock cylinder 12' cannot be rotated. When a key (not shown) is inserted into the key insertion hole 13', the contacting surface of each tumbler-pin 16' and the corresponding under-pin 11' is brought into agreement with a shear line or the annular wall surface 8', and the lock cylinder becomes rotatable. Then, a rotation of the key toward a unlocked position makes the cylinder lock unlocked.

However, drawbacks have been encountered in the above-discussed cylinder locks. That is, the tumbler-pins 16' can be seen through the key insertion hole 13' from the outside. Assuming that a complicated structure picking tool having a plurality of pushing rods is inserted into the key insertion hole 13', and then, the pushing rods push the respective tumbler-pins 16' upon being adjusted in their projection amount, an illegal unlock of the cylinder lock occurs. This type of lock renders difficult complete prevention in the case of theft.

SUMMARY OF THE INVENTION

It is an object of the present invention to provide an improved cylinder lock which can overcome the drawbacks encountered in conventional cylinder locks.

Another object of the present invention is to provide an improved cylinder lock which can prevent a picking tool for theft from being used.

A further object of the present invention is to provide an improved cylinder lock to be associated with a key, in which a key insertion hole or clearance of the cylinder lock is formed very thin or has a very small clearance dimension so that only a very thin cylindrical member of the key can be inserted through the key insertion hole.

A cylinder lock of the present invention is used in association with a key, in which the cylinder lock comprising a generally cylindrical casing having thereinside an annular wall surface. The casing has an annular front wall located in front of the annular wall surface in a key insertion direction. A lock cylinder is rotatably disposed inside the casing and slidably contacted with the annular wall surface. A key guide member is fixedly and coaxially connected with the lock cylinder to form an annular key insertion hole between it and the casing front wall. The key guide member is formed with a guiding depression located in front of the casing annular wall surface in the key insertion direction. At least one tumbler-pin is slidably disposed in the lock cylinder and biased in a direction opposite to the key insertion direction. The tumbler-pin has an end face which is able to be flush with the casing annular wall surface upon the key being inserted in the cylinder lock in the key insertion direction.

The key comprises a key plate. A key shank is fixedly secured to the key plate. A cylindrical member has first and second end sections which are opposite to each other. The first end section is fixedly secured to the key shank. A slider is slidably disposed inside the cylindrical member and locatable inside the second end section of the cylindrical member. The slider has a fitting projection which projects in the key insertion direction and coaxial with the cylindrical member. The fitting projection can fit in the guiding depression of the key guide member. A stopper is disposed at the second end section of the cylindrical member to prevent the slider from projecting beyond the end of the cylindrical member. A spring is disposed between the key shank and the slider.

With this arrangement, the opposite end sections of the cylindrical member of the key are respectively reinforced with the key shank and the slider, and therefore the wall thickness of the cylindrical member can be sharply reduced because the cylindrical member does not readily deform regardless of the wall thickness being very small. In this regard, it is possible to reduce the clearance of the key insertion hole so as not co allow the picking tool to be inserted into the key insertion hole, thereby effectively preventing an illegal unlocking of the cylinder lock. Thus, this cylinder lock is very highly effective in theft prevention.

DETAILED DESCRIPTION OF THE INVENTION

Figure 1:
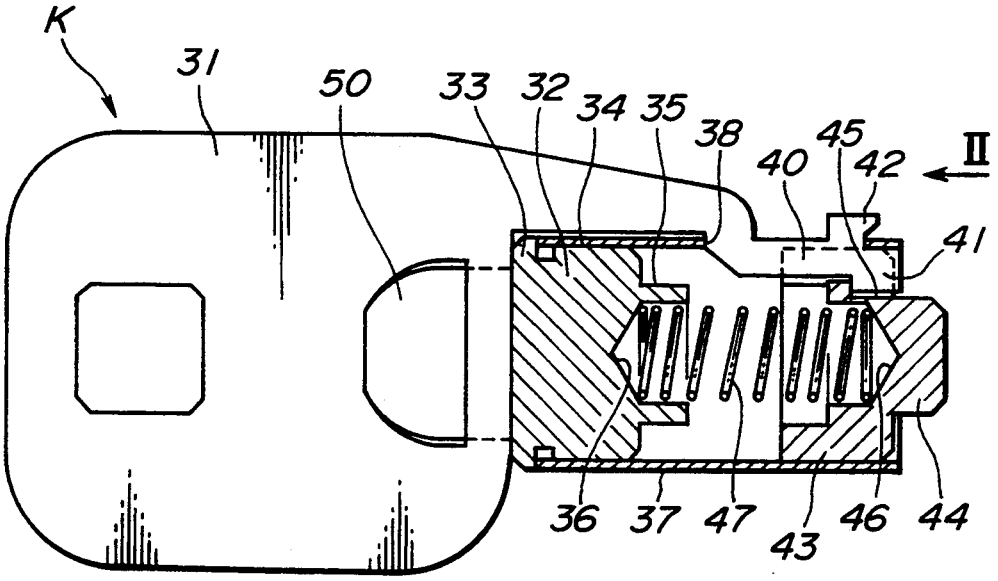
FIG. 1 is a side view, partly in section, of a key to be used in association with an embodiment of a cylinder lock according to the present invention.
Figure 2:
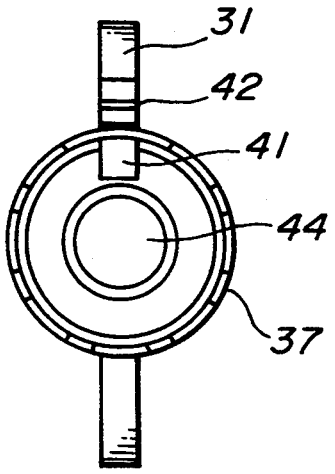
FIG. 2 is an end view of the key as viewed from a direction of arrow II of FIG. 1.
Figure 3:
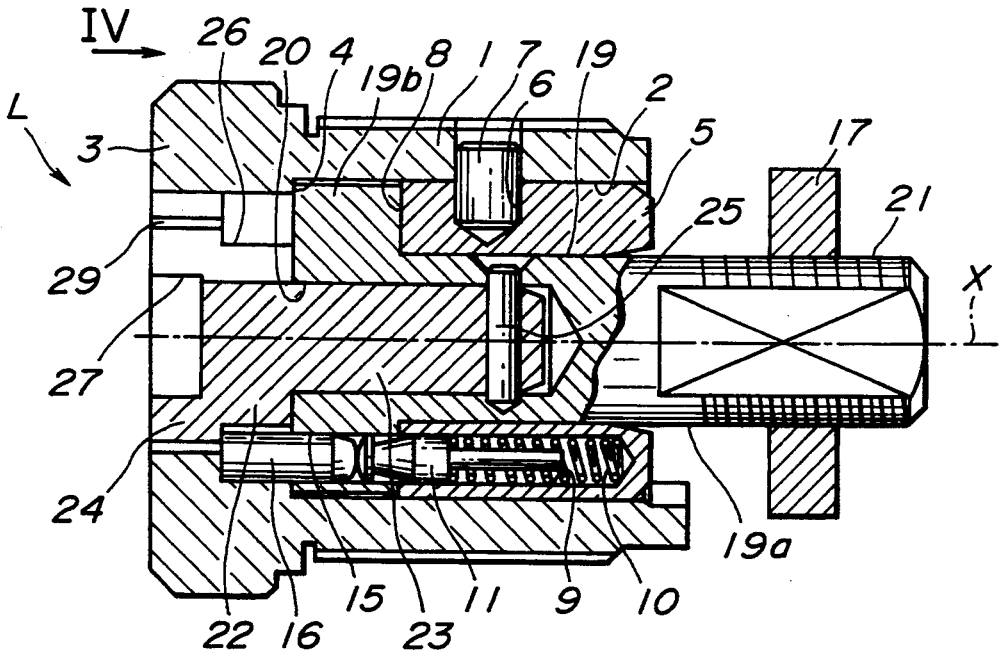
FIG. 3 is a vertical sectional view of the cylinder lock for which the key of FIG. 1 is to be used.
Figure 4:
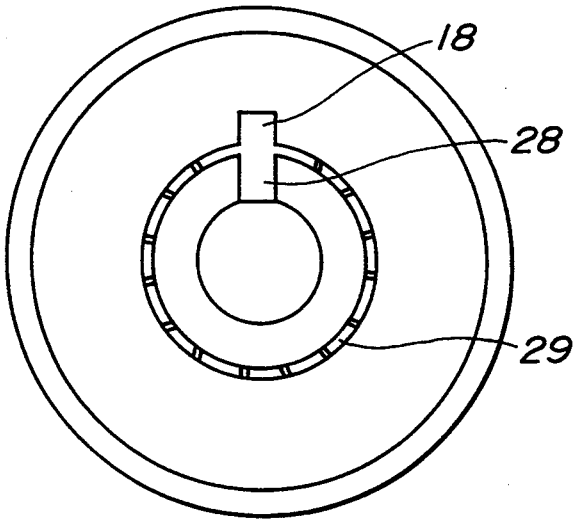
FIG. 4 is front end view of the cylinder lock as viewed from a direction of IV of FIG. 3.

Referring now to FIGS. 1 to 5, more specifically to FIGS. 3 and 4, a preferred embodiment of a cylinder lock according to the present invention will be illustrated by the reference character L. The cylinder lock L comprises a generally cylindrical casing 1 which is formed with a bore defined by its inner peripheral surface 2. The casing 1 is provided at its front end with a generally cylindrical thick front wall 3 which projects radially inwardly over the inner peripheral surface 2 to form an annular step wall surface 4 perpendicular to an axis X of the cylinder lock L. The step wall surface 4 is located between the inner peripheral surface of the front wall 3 and the inner peripheral surface 2. A generally cylindrical thick sleeve 5 is disposed at the rear half section of the bore of the casing 1. A hole 6 is formed in the casing 1 and the sleeve 5. The hole 6 is open at the outer peripheral surface of the casing 1. A fixing pin 7 is fitted in the hole 6 to fix the sleeve 5 to the casing 1. The front end face of the sleeve 5 forms an annular wall surface 8 perpendicular to the axis X and to the inner peripheral surface 2 of the casing 1.

A plurality of under-pin holes 9 are formed in the sleeve 5 and are open at the annular wall surface 8. Each under-pin hole 9 extends axially to a closed bottom located near the rear end face of the sleeve 5. An under-pin 11 is disposed in each under-pin hole 9. Accordingly, each under-pin 11 is biased in a direction to project forward over the annular wall surface 8 under the bias of a spring 10 disposed in the under-pin hole 9.

A lock cylinder 19 is rotatably disposed inside the casing 1 and includes a shaft section **19*a* slidably disposed inside the sleeve 5. The lock cylinder 19 is formed at its front end part with a generally annular flange section 19*b* which extends radially outwardly to a cylindrical surface (no numeral) that is in slidable contact with the inner peripheral surface 2 of the casing 1. The front end face of the flange section 19*b* is in slidable contact with the step wall surface 4, whereas the rear end face of the same flange section 19*b* is in slidable contact with the annular wall surface 8 of the sleeve 5. The shaft section 19*a* of the lock cylinder 19 projects rearward over the extreme end of the casing 1 and the sleeve 5 to form an end section (no numeral). The end section is formed at its peripheral surface with an external thread 21 which is in engagement with the internal thread (no numeral) of a nut 17**.

The flange section **19*b* of the lock cylinder 19 is formed with a plurality of tumbler-pin holes 15 which are brought into agreement or become coaxial respectively with the under-pin holes 9 when the lock cylinder 19 is in a locked position. Each tumbler-pin hole 15 extends axially and pierces through the flange section 19*b* to connect the front and rear end faces of the flange section 19*b*. A tumbler-pin 16 is inserted and disposed in each tumbler-pin hole 15**.

A key guide member 22 includes a shale section 23 which is inserted and fixedly disposed inside an axial hole 20 formed axially in the shaft section **19*a* of the lock cylinder 19. A fixing pin 25 is disposed through the shaft sections 19*a*, 23 of the lock cylinder 19 and the key guide member 22. The key guide member 22 includes a head section 24 integral with the shaft section 23. The head section 24 is rotatably disposed inside the annular front wall 3 and formed with an annular cutout (no numeral) which forms a cylindrical step surface 26 coaxial with the shaft section 23. It will be understood that the cylindrical step surface 26 is slightly smaller in diameter than the front end part of the head section 24. Additionally, the head section 24 is formed at its front end face with a circular depression 27 which is coaxial with the shaft section 23 and provided for the purpose of guiding a key K shown in FIGS. 1 and 2**.

As shown in FIG. 4, the front wall 3 is formed at its inner peripheral surface with a key guide groove 18 for the purpose of regulating the posture of the key K to be inserted into the lock L. In connection with this, the head section 24 of the key guide member 22 is formed with a key guide groove 28 which is brought into agreement or coincides with the key guide groove 18 when the lock cylinder 19 is in the locked position as clearly illustrated in FIG. 4. It will be understood that a key insertion hole or clearance 29 is formed between the outer peripheral surface of the key guide member head section 24 and the inner peripheral surface of the casing front wall 3 as shown in FIG. 4. This key insertion hole or clearance 29 is formed as narrow or thin as possible within a range in which a thin cylindrical section 37 of the key K (as discussed below) can be inserted into the hole or clearance 29.

While the lock cylinder 19 and the key guide member 22 have been shown and described as being formed independent from each other and arranged to be connected with each other by means of the fixing pin 25, it will be understood that they may be formed integral with each other to take a one-piece structure.

The key K to be used for the above-discussed lock L will be discussed. As shown in FIGS. 1 and 2, the key K includes a key plate 31 which is formed with a hole (no numeral) in which a left end section 50 of a generally cylindrical key shank 32 is inserted as shown in FIG. 1. The left end section 50 is caulked after component parts of the key K are assembled, so that the component parts of the key K are rigidly assembled as a single structure. The key shank 32 is formed at its central part with an outer peripheral surface 34 for the fitting purpose. Additionally, the key shank 32 is formed at its right end part with a cylindrical projection 35 which is coaxial with the fitting outer peripheral surface 34. A spring seat 36 is formed inside the cylindrical projection 35.

The thin cylindrical member 37 formed of a metal is fittingly mounted at its left end section on the key shank 32 at the fitting outer peripheral surface 34. An elongate opening 38 is formed through the cylindrical wall of the cylindrical member 37 and located generally at the right half and at the upper part of the cylindrical member 37. The elongate opening 38 extends generally from the central portion to a portion near the right end of the cylindrical member 37.

The key plate 31 has an tip end section 40 which extends rightward and inserted through the elongate opening 38 inside the cylindrical member 37. The tip end section 40 further extends near the right end of the cylindrical member 37 and formed at its tip end with a guide projection 41 which is to be inserted into the key guide groove 28. The tip end section 40 is further formed at its upper part with a guide projection 42 which projects through the elongate opening 38 outside of the cylindrical member 37 to be inserted into the key guide groove 18. The inside guide projection 41 serves also as a stopper which prevents a slider 43 (discussed after) from projecting rightward.

The slider 43 is slidably disposed at the right end part of the cylindrical member 37 and formed at its right or tip end with a circular fitting projection 44. The slider 43 is formed near the projection 44 with a cutout groove 45 which is to be engaged with the guide projection 41. The slider 43 is formed at its left end with a groove (no numeral) serving as a spring seat 46. A slider spring 47 is provided between the key shank 32 and the slider 43 and in such a manner that the opposite ends thereof are respectively seated on the spring seats 36, 46 of the key shank 32 and the slider 43. Accordingly, the slider 43 is biased by the slider spring 47 in a direction to project from the right end of the cylindrical member 37 so that when the key is removed from the cylinder lock L the right side wall surface of the cutout groove 45 strikes or abuts up against the guide projection 41. At this time, the fitting projection 44 is in a skate to project from the right end of the cylindrical member 37 as shown in FIG. 1.

In this embodiment, the wall thickness of the cylindrical member 37 is set as small as possible within a range in which the cylindrical member 37 is readily deformable under an outside force acting on its outer peripheral surface but does not deform under a pressure acting thereto in a key insertion direction (indicated by an arrow D in FIG. 5) in which the key K is inserted into the lock L. However, from the arrangement of the cylindrical member 37 in the key K, it will be appreciated that there is no possibility of the original cylindrical shape of the cylindrical member 37 being deformed even if an outside force acts on the peripheral surface of the cylindrical member 37 because the insides of the left and right end sections of the cylindrical member 37 are respectively filled with the central section of the key shank 32 and the slider 43.

The function and advantageous effects of the above-discussed cylinder lock L to be associated with the key K will be discussed with reference to FIG. 5.

The cylindrical member 37 of the key K is formed as thin as possible within the range in which the key K is readily insertable into the lock L while allowing the key K to be rotatable to the locking or unlocking position. In connection with this, the key insertion hole or clearance 29 is formed as narrow as possible within a range of allowing the cylindrical member 37 of the key K to be insertable. Accordingly, the key insertion hole or clearance 29 of this embodiment is formed very narrow or thin as compared with that in conventional cylinder locks. In other words, the key insertion hole 29 has a very small clearance dimension or radial distance between the inner peripheral surface of the casing front wall 3 and the outer peripheral surface of the key guide member head section 24.

In this regard, it will be appreciated that there exists a limitation to make thin the pushing rods of a picking tool, and therefore it is impossible to insert the pushing rods into such a narrow or thin key insertion hole or clearance 29 of the above-discussed embodiment of the present invention. Thus, there is no possibility of the cylinder lock L of this embodiment being illegally unlocked.

Since the insides of the left and right end sections of the cylindrical member 37 are respectively filled with the central section of the key shank 32 as mentioned above, the opposite end sections of the cylindrical member 37 is effectively reinforced thereby preventing the cylindrical member 37 from its deformation (missing the right cylindrical shape) even upon application of the outside force onto the outer peripheral surface thereof. For example, even if the key K is dropped onto a floor or the ground, the cylindrical member 37 is prevented from missing its right cylindrical shape.

When the key K is approached to the key insertion hole 29 of the cylinder lock L, the fitting projection 44 at the tip end of the slider 43 is inserted in the guiding depression 27 to serve as a guide for the insertion position and direction of the key K. Accordingly, the key K can be rightly inserted into the key insertion hole 29 so that the thin cylindrical member 37 receives only a pressure in its insertion direction and does not receive a side pressure perpendicular to the outer peripheral surface of the cylindrical member 37.

At this time, the tip end face of the fitting projection 44 comes into contact with the bottom surface of the guiding depression 27. When the key K is further inserted, the slider 43 slides leftward as shown in FIG. 5 along the inner peripheral surface of the cylindrical member 37; however, the fitting projection 44 is maintained in a state to be fitted in the guiding depression. 27.

The key K is then formed into a one-piece structure by firmly assembling the key plate 31, the key shank 32, the thin cylindrical member 37 and the slider 43 without play or relative movement among them or the or component parts. Additionally, the fitting projection 44 of the slider 43 is fitted in the guiding depression 27 of the cylinder lock L, and, therefore, the cylindrical member 37 cannot receive the side pressure applied perpendicular to the cylindrical wall of the cylindrical member 37.

Figure 5:
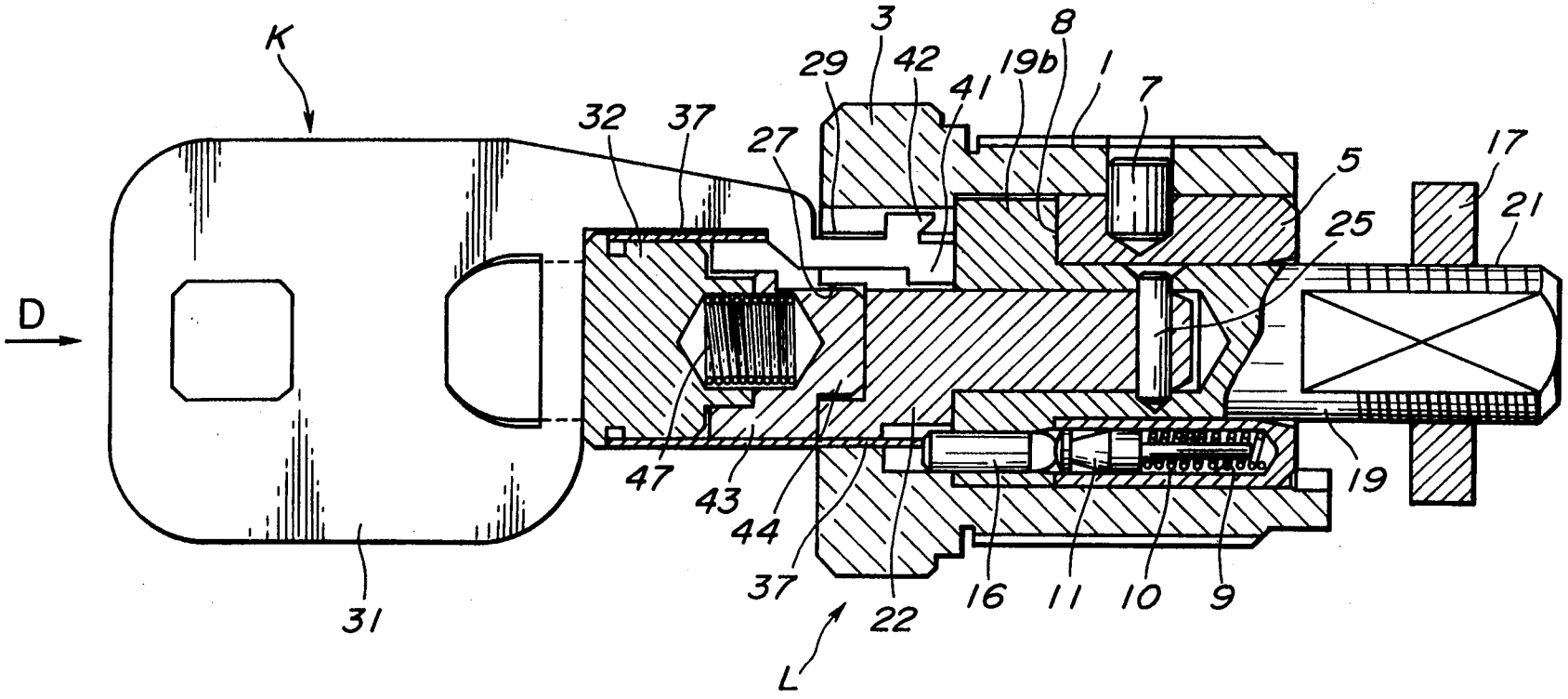
FIG. 5 is a vertical sectional view of the key and the cylinder lock in a state in which the key is inserted into the cylinder lock.
Figure 6:
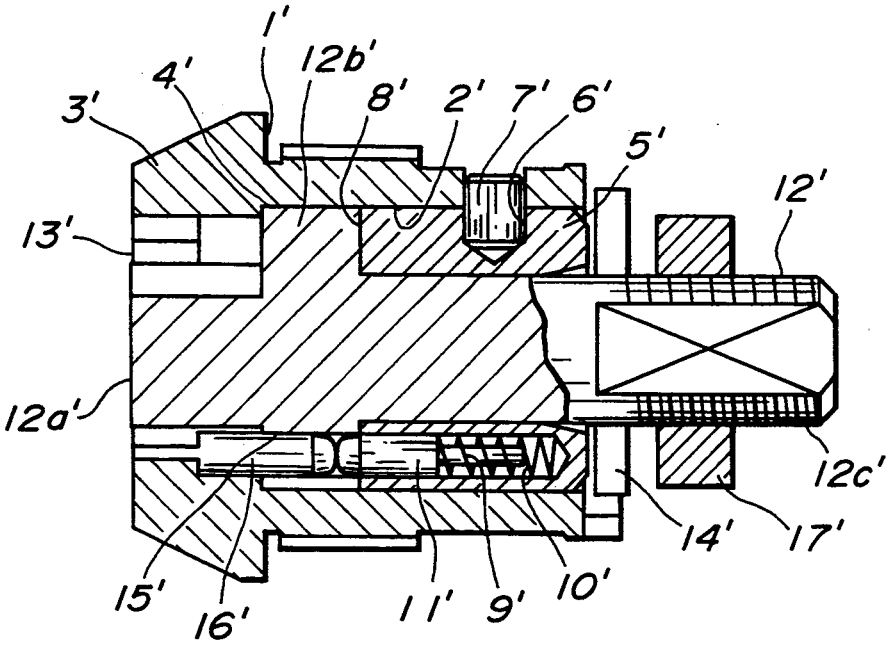
FIG.6 (PRIOR ART)
FIG. 6 is a vertical sectional view of a conventional cylinder lock.

Upon such insertion of the key K into the cylinder lock L to establish a state shown in FIG. 5, the rear or left end face of each tumbler-pin 16 is brought into agreement with or flushes with the annular wall surface 8 (or the shear line) as shown in FIG. 5, so that the lock cylinder 19 becomes rotatable. Accordingly, the key K can be rotated under a small force to be applied to the key plate 31, thereby accomplishing a locking or unlocking operation of the cylinder lock L.

When the key K is extracted from the cylinder lock L after the key K is returned to its locking position, the fitting projection 44 is maintained in the guiding depression 27, so as to rightly guide the cylindrical member 37 in a direction to be extracted, until the cylindrical member 37 has been extracted from the key insertion hole 29. Accordingly, there is no possibility of the thin cylindrical member 37 receiving the side pressure during extraction of the key K from the cylinder lock L. After the cylindrical member 37 is separated from the key insertion hole or clearance 29, the fitting projection 44 is disengaged from the guiding depression 27 and returned to its original position at which the fitting projection 44 projects from the tip end of the cylindrical member 37.

What is claimed is:

1. A cylinder lock and key, said cylinder lock comprising;

a generally cylindrical casing having means defining thereinside an annular wall surface, said casing having an annular front wall located in front of said annular wall surface in a key insertion direction, a lock cylinder rotatably disposed inside said casing and slidably contacted with said annular wall surface, a key guide member fixedly and coaxially connected with said lock cylinder to form an annular key insertion hole between it and said casing front wall, said key guide member being formed with a guiding depression located in front of said casing annular wall surface in the key insertion direction, at least one tumbler-pin slidably disposed in said lock cylinder and biased in a direction opposite to the key insertion direction, said at least one tumbler-pin having an end face which is able to be flush with said casing annular wall surface upon said key being inserted in said cylinder lock in the key insertion direction;

said key comprising;

a key plate, a key shank fixedly secured to said key plate;

a cylindrical member having first and second end sections which are opposite to each other, the first end section being fixedly secured to said key shank;

a slider slidably disposed inside said cylindrical member and locatable inside the second end section of said cylindrical member, said slider having a fitting projection which projects in the key insertion direction and is coaxial with said cylindrical member, said fitting projection being able to fit in said guiding depression of said key guide member, a stopper disposed at the second end section of said cylindrical member to prevent a projection of said slider from said cylindrical member, and a spring disposed between said key shank and said slider.

2. A cylinder lock and key as claimed in claim 1, wherein said cylindrical member of said key is so small in its wall thickness as to be readily deformable by an outside force acting on its outer peripheral surface and not deformable by a pressure acting axially thereto during insertion of said key into said cylinder lock.

3. A cylinder lock and key as claimed in claim 1, further comprising means by which said key insertion hole is formed as small as possible in its clearance dimension within a range to allow said key to be inserted into said key insertion hole.

4. A cylinder lock and key as claimed in claim 1, wherein said annular wall surface of said casing is perpendicular to an axis of said casing.

5. A cylinder lock and key as claimed in claim 4, wherein said at least one tumbler-pin is located parallel with the axis of said casing.

6. A cylinder lock and key as claimed in claim 1, wherein a part of said key shank is securely fitted in the first end section of said cylindrical member of said key.

* * * * *